US006637685B1

(12) United States Patent
Kruger

(10) Patent No.: US 6,637,685 B1
(45) Date of Patent: Oct. 28, 2003

(54) PILL CRUSHER

(76) Inventor: Dennis Kruger, 33050 Whidden Avenue, Mission, British Columbia (CA), V2V 2T2

( * ) Notice: Subject to any disclaimer, the term of this patent is extended or adjusted under 35 U.S.C. 154(b) by 0 days.

(21) Appl. No.: 10/179,265

(22) Filed: Jun. 26, 2002

(51) Int. Cl.[7] ..... B02C 19/08

(52) U.S. Cl. ..... 241/169.1; 241/169.2; 241/DIG. 27

(58) Field of Search ..... 241/169.1, 169.2, 241/168, DIG. 27, 169

(56) References Cited

U.S. PATENT DOCUMENTS 2,631,786 A 3/1953 Morgan et al.
3,915,393 A 10/1975 Elkins
6,059,209 A 5/2000 Barson
6,357,679 B1 3/2002 Radke
6,508,424 B1 * 1/2003 Marshall ..... 241/169.1

* cited by examiner

*Primary Examiner*—Mark Rosenbaum

(57) ABSTRACT

A pill crusher has an arm extending over and along an elongate base, with a pivotal connection between the base and one end of the arm. An upwardly open cylindrical housing on the base has a longitudinal axis perpendicular to the base and a compression spring in the cylindrical housing between a cylindrical anvil member and the base. Interengaged guide formations on the housing and the anvil member at opposite sides of the housing are inclined so as to cause rotational movement of the anvil member relative to the cylindrical housing on displacement of the anvil member along the longitudinal axis against the action of the spring; and a cylindrical pressure member depending from the arm above the cylindrical housing. In use, the rotational movement of the anvil member causes a pill to be both crushed and also simultaneously ground between the pressure and anvil members, which have serrated opposed faces to improve the grinding.

11 Claims, 3 Drawing Sheets

PILL CRUSHER

BACKGROUND OF THE INVENTION

1. Field of the Invention

The present invention relates to pill crushers for use in crushing medicaments in the form of pills or tablets.

2. Description of the Related Art

Medications are commonly provided in the form of pills or tablets, and it is well known that these can be difficult to swallow for various persons. Consequently, various pill crushers have been proposed in the prior art for crushing pills and tablets so as to convert the medications into powder form, which can be more easily ingested by such persons.

For example, U.S. Pat. No. 3,915,393, issued Oct. 20, 1975 to Bill Webb Elkins, discloses an apparatus for crushing medications, such as pills, tablets and the like, which includes a base member having a crushing bowl formed therewith, which is adapted to receive a medication cup containing medicine to be crushed. The apparatus further-includes a crushing arm pivotally mounted on the base member and having a crusher head mounted on the crushing arm. By pivoting the crushing arm relative to the base member, the crusher head can be forced downwardly onto the medication, which is contained between a pair of interengaged cups positioned in the crushing bowl.

In this prior apparatus, the crushing head is fixedly secured to the crushing arm, and the interengaged cups are supported on the base member. Therefore, there is no relative rotational movement between the undersurface of the crushing head, and the upper surface of the base member, on which the cups are supported, during the crushing of the medication. Consequently, it has been found, in practice, that the medications are not sufficiently pulverized by such crushing action.

In U.S. Pat. No. 6,357,679, issued Mar. 19, 2000 to George F. Radke, there is disclosed apparatus for crushing medication having a crushing member which is rotatable relative to an anvil, as medication is crushed between the crushing member and the anvil. More particularly, this prior apparatus has an anvil mounted on a base, and a crusher member mounted in a housing for rotation about a first, horizontal axis relative to the housing. The housing has a cam surface which mates with a follower connected to the base, which produces rotational movement of the housing about a second, vertical rotational axis as the crushing member with its housing are displaced downwardly, toward the anvil, in order to a crush medication provided between interengaged cups between the crusher member and that the anvil.

It is, however, a disadvantage of the apparatus of U.S. Pat. No. 6, 357,679 that the force required for crushing medication must be directed vertically downwardly onto the housing, so that there is no lever action between the crusher member and the anvil. Consequently, this prior art apparatus cannot easily be employed by weak or otherwise disabled persons.

BRIEF SUMMARY OF THE INVENTION

It is, accordingly, an object of the present invention to provide a novel and improved pill crusher which improves the crushing of pills without requiring the application of any significant amount of strength.

According to the present invention, a pill crusher comprises an arm extending over and along an elongate base, with a pivotal connection between the base and one end of the arm. An upwardly open, cylindrical housing on the base has a longitudinal axis perpendicular to the base, and a cylindrical anvil is provided in the cylindrical housing on a compression spring located between the anvil member and the base.

Interengaged guide formations on the cylindrical housing and the anvil member,at opposite sides of the housing, are inclined so as to cause rotational movement of the anvil member relative to the cylindrical housing upon displacement of the anvil member against the action of the spring. A cylindrical pressure member depends from the arm above the cylindrical housing.

When the apparatus according to the present invention is in use, a pill it is inserted into a cup, and another cup is interengaged with the first cup, so that the pill is located between the two cups. The two cups, with the pill between them, are then placed on the anvil member, and the arm is pivoted downwardly to bring the cylindrical pressure member into the uppermost cup. During further downward movement of the pressure member toward the anvil member, the pill is crushed between the pressure member and the anvil member. Furthermore, during this crushing of the pill, the downward movement of the pressure member causes the anvil member to be downwardly displaced relative to the cylindrical housing. This movement of the anvil member relative to the cylindrical housing, through the interengaged formations, causes relative rotational movement of the pressure member and the anvil member. Therefore, the pill it is not only crushed but is, also, simultaneously ground between the two cups.

The combination of the force exerted on the pressure member by the lever action of the arm, with the grinding of the medication caused by the relative rotation of the pressure member and the anvil member, has been found to produce improved pulverization of the medication.

Furthermore, but it has been found that the pulverization of the medication can be still further improved by the provision of serrations on opposed services of the pressure member and the anvil member.

BRIEF DESCRIPTION OF THE DRAWINGS

The present invention will be more readily understood from the following description of a preferred embodiment of thereof, given by way of example with reference to the accompanying drawings, in which.

THE PREFERRED EMBODIMENT

Figure 1:
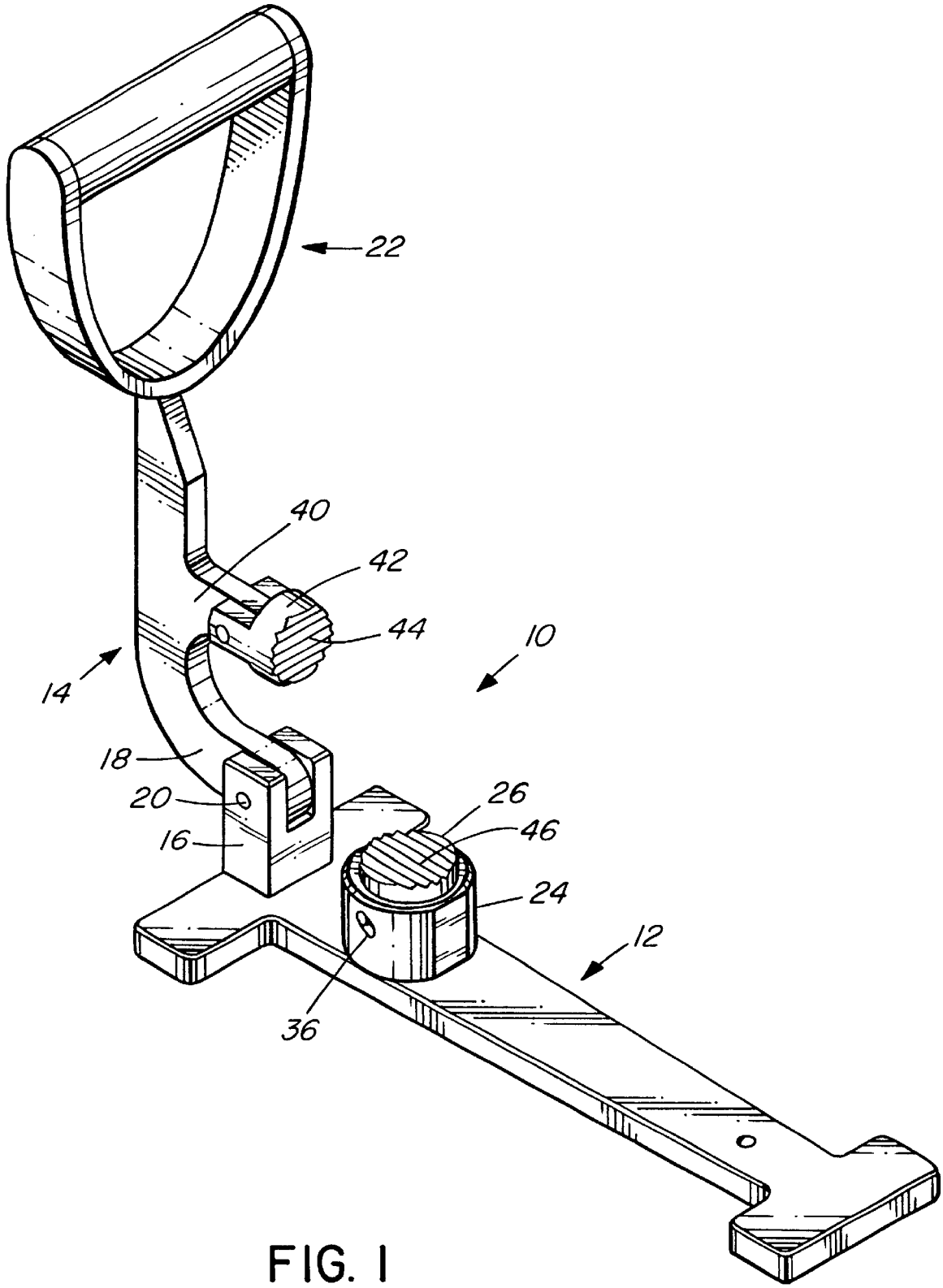
FIG. 1 shows a view in perspective of a pill crusher according to the present invention.

In the accompanying drawings, there is shown a pill crusher, indicated generally by reference numeral 10, which has an elongate base, indicated generally by reference numeral 12, and an arm indicated generally by reference numeral 14.

The base 12 is provided, at one end of the base 12, with an upstanding, bifurcated block 16, to which a lug 18 on one end of the arm 14 is connected by a pivot pin 20, so that there is a pivotal connection between this end of the arm 14 and the base 12.

A spade handle, indicated generally by reference numeral 22, is provided at the opposite end of the arm 14 to facilitate pivotation of the arm 14 to and fro about the horizontal axis of the pivot pin 20, relative to the base 12, by a weak or otherwise disabled person.

On the base 12, there is provided a cylindrical housing 24, which has a longitudinal axis perpendicular to the base 12, i.e. a vertical longitudinal axis.

A cylindrical anvil member 26, which is coaxial with the cylindrical housing 24, is provided in the housing 24 and protrudes upwardly from the top of the housing 24. As can be seen from FIG. 3, the anvil member 26 is mounted on a helical compression spring 28, which is located between the base and the underside of the anvil member 26. The compression spring 28 is partially accommodated in a boring 30 in the bottom of the cylindrical housing 24, and receives a downwardly protruding cylindrical projection 34 on the underside of the anvil member 26.

The cylindrical housing 24 and the anvil member 26 are formed with interengaged formations in the form of downwardly inclined slots 36 in the wall of the cylindrical housing 24 and projections in the form of grub screws 38 projecting, at opposite sides of the anvil member 26, from the anvil member 26, with which they are in threaded engagement, into the slots 36 in the cylindrical housing 24. The slots 36 form cam surfaces, and the grub screws 38 form cam followers in contact with these cam surfaces, so that when the anvil member 26 is displaced downwardly relative to the cylindrical housing 24, as described below, it is simultaneously rotated, through a few degrees, about to the vertical longitudinal axis of the cylindrical housing 24.

Figure 3:
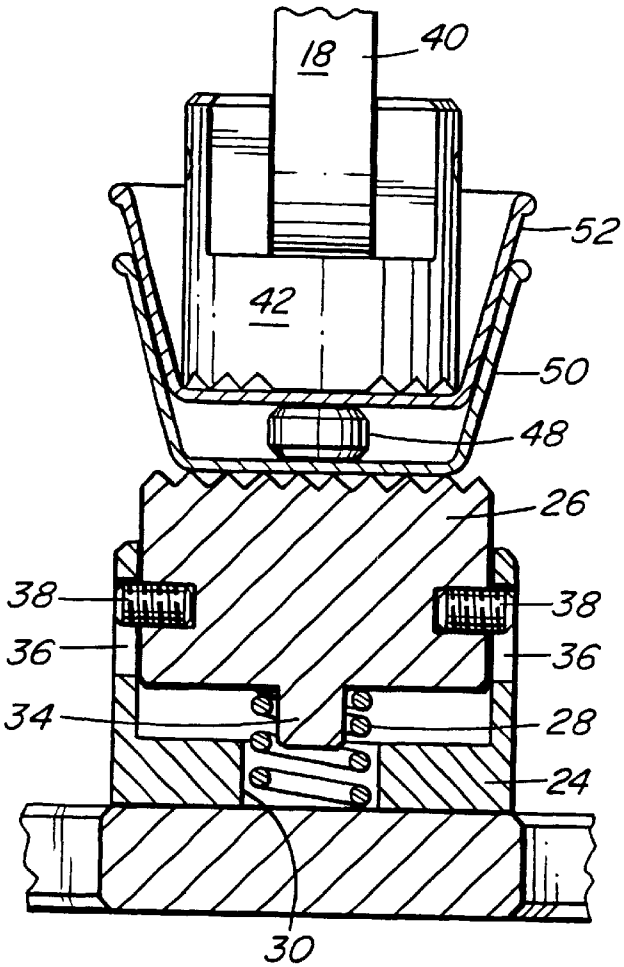
FIG. 3 shows a view taken in cross-section along the line 3—3 of FIG. 2.

The arm 14 is formed, between the lug 18 and the handle 22, with a downwardly projecting extension 40, at the lower end of which a pressure member 42 is pivotally connected by a pivot pin 43 (FIG. 3). The downward extension 40 is so located that, on pivotation of the arm 14 downwardly about the pivot pin 20 toward the base 12, the pressure member 42 is brought downwardly onto and substantially in alignment with the anvil member 26, as shown in FIGS. 2 and 3.

Furthermore, the cylindrical housing 24 is located at a position along the length of the base 12 which is relatively close to the pivot pin 20, and as will be apparent to those skilled in the art, the purpose of this is to provide an appropriate lever moment to facilitate the pressing of the pressure member 42 downwardly onto the anvil member 26, by a person grasping the handle 22, in such a manner as to substantially minimize the force required to be exerted by that person on the handle 22.

The underside of the pressure member 42 is formed with serrations 44, and the top of the anvil member 26 is formed with serrations 46.

Figure 2:
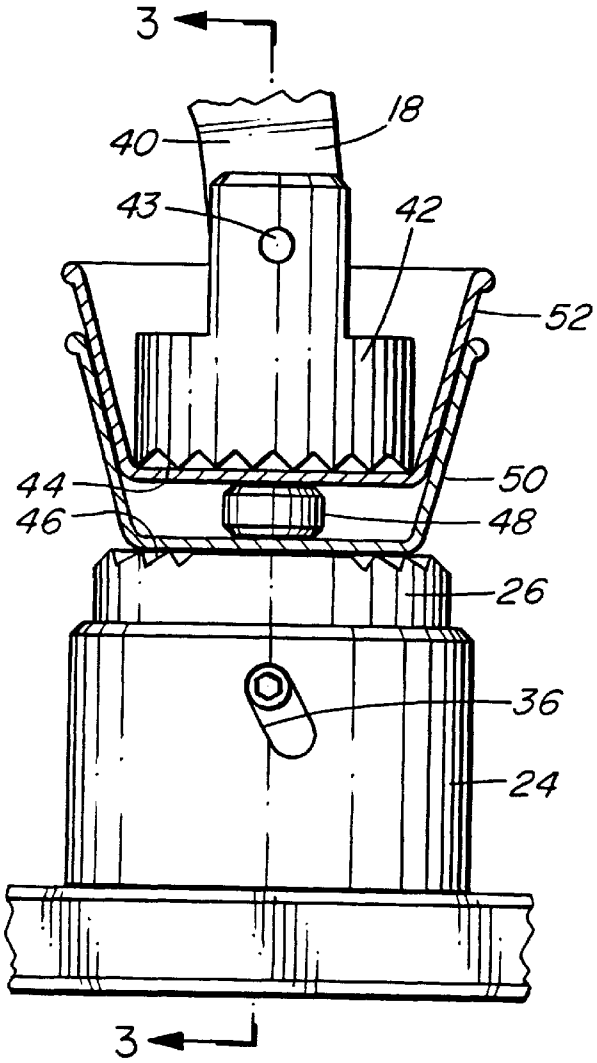
FIG. 2 shows a broken-away side view of parts of the pill crusher of FIG. 1.
Figure 5:
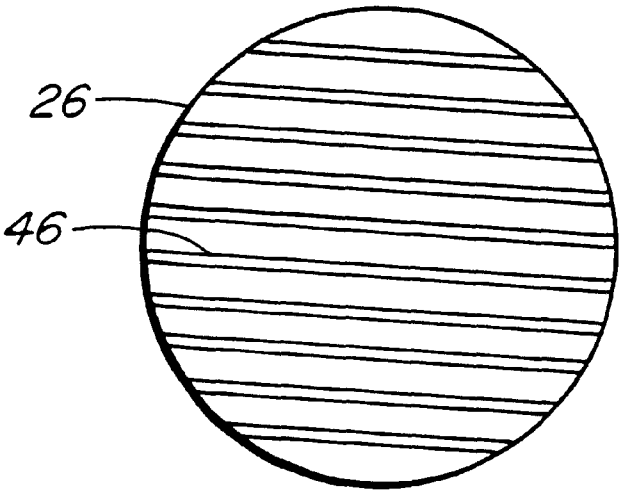
FIGS. 4 and 5 show top plan views of an anvil member, which is a component of the pill crusher of the FIG. 1, in a partially rotated position and a normal position, respectively.
Figure 4:
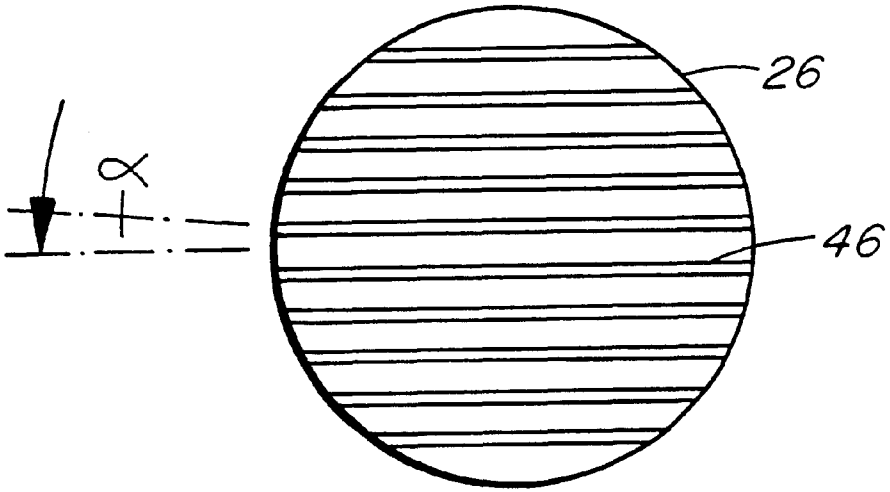

During operation of the pill crusher 10, a pill or tablet 48 is inserted into a first cup 50, and a second cup 52 is then inserted into the cup 50 on top of the pill 48, as shown in FIG. 2. The thus-interengaged cups 50 and 52, with the pill 48 between them, are mounted on the top of the anvil member 26, and the lever arm 14 is pivoted about the pivot pin 20 to bring the pressure member 42 downwardly into the uppermost cup 52 until it presses the base of the cup 52 downwardly onto the pill 48. Further downward movement of the pressure member 42 causes crushing of the pill 48 and, simultaneously, forces the anvil member 26 to be displaced downwardly relative to the cylindrical housing 24. Due to the grub screws 38 and the slots 36, this downward movement of the anvil member 26 relative to the cylindrical housing 24 causes a simultaneous partial rotational movement of the anvil member 26, about the vertical longitudinal axis of the cylindrical housing 24, as described above, through an angle $\alpha$, as shown in FIG. 4, from its normal, unrotated position, in which it is shown in FIG. 5, so that the pill 48 is simultaneously ground as well as being crushed. This combination of crushing and grinding of the pill 48, which it is facilitated by the serrations 44 and 46, produces a very effective pulverization of the pill 48.

As will be appreciated by those skilled in the art, various modifications may be made in the above-described embodiment of the present invention within the scope of the appended claims.

For example, the spade handle 22 may be replaced by a crossbar, extending at right angles to the length of the arm 14 and secured by a screw to the free end of the arm 14. This facilitates gripping of the handle.

In that case, the shape of the arm may be modified so that the arm curves downwardly from the extension 40 and then extends substantially vertically to the crossbar, so that there is less obstruction to the fingers of a user gripping the handle.

I claim:

1. A pill crusher, comprising:

an elongate base;

an arm extending over and along said elongate base;

a pivotal connection between said base and one end of said arm;

an upwardly open cylindrical housing on said base, said cylindrical housing having a longitudinal axis perpendicular to said base;

a cylindrical anvil member in said cylindrical housing;

a compression spring in said cylindrical housing between said anvil member and said base;

interengaged guide formations on said housing and said anvil member at opposite sides of said housing, said guide formations being inclined so as to cause rotational movement of said anvil member relative to said cylindrical housing on displacement of said anvil member along said longitudinal axis against the action of said spring; and a cylindrical pressure member depending from said arm above said cylindrical housing.

2. A pill crusher as claimed in claim 1, wherein said interengaged formations comprise cam surfaces on said cylindrical housing and cam followers projecting from said anvil member into contact with said cam surfaces.

3. A pill crusher as claimed in claim 1, wherein said interengaged formations comprises slots in said cylindrical housing and projections extending from the opposite sides of said anvil member into said slots.

4. A pill crusher as claimed in claim 1, wherein said pressure member has a serrated undersurface facing said anvil member.

5. A pill crusher as claimed in claim 1, wherein said anvil member has a serrated upper surface.

6. A pill crusher as claimed in claim 1, including a pivotal connection between said arm and said pressure member, said pivotal connection having an axis of pivotation transverse to the length of said arm.

7. A pill crusher as claimed in claim 1, wherein said anvil member protrudes upwardly from said cylindrical housing.

8. A pill crusher as claimed in claim 1, including a spade handle at an opposite end of said arm.

9. A pill crusher, comprising:

a base;

an upwardly open cylindrical housing on said base;

a compression spring in said cylindrical housing;

an anvil member on said compression spring, said anvil member being downwardly movable relative to said cylindrical housing against the action of said compression spring;

an arm extending over said base;

a pivotal connection between one end of said arm and said base;

a pressure member depending from said arm above said cylindrical housing and movable onto said anvil member, by pivotation of said arm relative to said base, to effect downward displacement of said anvil member relative to said cylindrical housing; and means for effecting relative rotational movement of said pressure member and said anvil member during said downward displacement.

10. A pill crusher as claimed in claim 9, wherein said anvil member and said pressure member have opposed serrated surfaces.

11. A pill crusher as claimed in claim 9, wherein said means for effecting relative rotational movement comprises cam surfaces and cam followers on said anvil member and said pressure member.

* * * * *